US007475787B2

(12) United States Patent
Gruver et al.

(10) Patent No.: US 7,475,787 B2
(45) Date of Patent: Jan. 13, 2009

(54) INDUCTION HEATABLE CONTAINER WITH PROTECTIVE END CAPS

(75) Inventors: John Gruver, New Caanan, CT (US); Gary Mengeu, Wheeling, WV (US); Michelle Gagnon, Chicago, IL (US)

(73) Assignee: PepsiCo, Inc. and Silgan Plastics, Inc., Purchase, NY (US)

( * ) Notice: Subject to any disclaimer, the term of this patent is extended or adjusted under 35 U.S.C. 154(b) by 277 days.

(21) Appl. No.: 11/262,359

(22) Filed: Oct. 28, 2005

(65) Prior Publication Data

US 2007/0095847 A1 May 3, 2007

(51) Int. Cl.
*A47J 41/00* (2006.01)
*B65D 51/20* (2006.01)
*B65D 81/38* (2006.01)

(52) U.S. Cl. ..... 220/258.2; 220/258.3; 220/592.17; 220/592.2; 220/592.24; 220/739

(58) Field of Classification Search ..... 220/780, 220/713, 258.1–258.3, 716, 717, 739, 740, 220/906, 212, 592.17, 215, 592.24, 592.25, 220/592.27, 592.2

See application file for complete search history.

(56) References Cited

U.S. PATENT DOCUMENTS

| | | | | | |
|---|---|---|---|---|---|
| 3,317,087 | A * | 5/1967 | Landis | 222/143 |
| 4,572,016 | A * | 2/1986 | Okoshi | 476/40 |
| 5,273,182 | A * | 12/1993 | Laybourne | 220/740 |
| 6,450,358 | B1 * | 9/2002 | Berro | 220/258.2 |
| 6,910,598 | B2 * | 6/2005 | Gotz et al. | 220/258.3 |
| 7,017,769 | B1 * | 3/2006 | Talmon | 220/258.2 |
| 2001/0040163 | A1 * | 11/2001 | Song | 220/258 |
| 2003/0146226 | A1 * | 8/2003 | Couto | 220/717 |
| 2003/0178433 | A1 * | 9/2003 | Adams | 220/703 |
| 2003/0222083 | A1 * | 12/2003 | Pladsbjerg | 220/254.3 |
| 2004/0060935 | A1 * | 4/2004 | Perra | 220/253 |

* cited by examiner

*Primary Examiner*—Anthony D Stashick
*Assistant Examiner*—Niki M Eloshway
(74) *Attorney, Agent, or Firm*—Banner & Witcoff, Ltd.

(57) ABSTRACT

A beverage can with top and bottom heat barrier ends for protecting the user from scalding when consuming a beverage heated by induction heating.

14 Claims, 5 Drawing Sheets

INDUCTION HEATABLE CONTAINER WITH PROTECTIVE END CAPS

BACKGROUND OF THE INVENTION

1. Field of the Invention

The present invention relates to beverage containers. More particularly, the present invention relates to a metal beverage container that is suitable for heating by induction heating and dispensing from a vending machine having an insulating label and snap-on ends that serve as a barrier to the heat radiating from the liquid and the container, thereby protecting the user from being scalded.

2. Description of the Prior Art

Typical conventional vending machines serving beverages in containers or cans have columns for storing beverage containers and chutes for delivering cans to an exit area of the machine. Vending machine beverages, including coffees, teas and hot chocolate, for example, that are to be served hot are advantageously stored at room temperature or below to preserve the flavor of such beverages. Such beverages must be heated prior to dispensing. The heating can be accomplished in a suitable manner in the vending machine. The heating may be done by induction or magnetic heating upon an order given by the purchaser by making a selection of a beverage and payment.

A need exists for a metal beverage container that is suitable for induction heating and for dispensing by a vending machine the resulting hot beverage. A need also exists for a beverage container that protects the purchaser from scalding his fingers and/or lips. In addition, a need exists for a container that reduces or prevents spillage of the hot beverage.

SUMMARY OF THE INVENTION

The present invention provides a beverage container with protective top and bottom end caps or covers that serve as protective covers and heat barriers. In one embodiment, the protective covers or caps are affixed to the beverage container in a snap-on or frictional engagement. Other structure may be utilized to attach the top and bottom end caps to the container. In one embodiment, the top and bottom end caps can be readily removed from the container, if desired.

The beverage container typically is one that is capable of being heated by induction heating, such as in a vending machine, and thus is hot upon dispensing. The top protective cover or cap conforms to the size of the lid of the beverage container, typically a metal can, so that when the heated liquid passes through the lid of the beverage container for consumption, the user's lips are protected from the heat of the container by the barrier.

In one embodiment, the protective cover or cap of the invention comprises a generally circular heat barrier cover having an inside wall and an outside wall. The walls extend upwardly forming an edge where the walls join. A floor in the cover is integrally joined to the inside wall providing a smooth surface and a first aperture for allowing the contained beverage to be dispensed therethrough when the aperture is aligned over the opening of the container. A spout is integrally formed on the cover adjacent the aperture, generally in the direction of flow of the liquid contents of the container. A second aperture is located on the floor of the cover adjacent the spout so that the user may access the mechanism for opening the container, which typically is a pop-top. In one embodiment, the first aperture follows the curvature of the inside wall of the cover to provide for efficient drinking and dispensing of the liquid directly from the container. In one embodiment, a circumferential flange provides snap-on attachment of the cover to a rim on the beverage container.

In one embodiment, an airspace is provided between the top of the container and the spout, which can provide further insulating properties to prevent heat from transferring from the container to the top protective cover.

Typically, the beverage container is cylindrical in shape and capable of holding liquids that are treated by induction heating. In one embodiment, the container also has a bottom snap-on end. The second circular heat barrier cover or bottom snap-on end generally conforms to the bottom of the container having an inside and outside wall. The walls extend downwardly forming an edge. The second heat barrier cover is attached to the rim of the bottom of the container by a circumferential flange. The beverage container includes a lid, a bottom and a circular wall connecting the two. The lid has suitable means for opening and for the egress of liquid to the user. The wall of the container is insulated to keep the liquid contents, which may be, for example, coffee, tea or hot chocolate at an increased temperature.

The heat barrier properties of the covers on the top and bottom ends prevent injury by users of the container while consuming heated liquids dispensed from a vending machine. The bottom end prevents heat damage to the surface where the container may be placed.

BRIEF DESCRIPTION OF THE DRAWINGS

The invention will now be described with reference to the drawings wherein.

DETAILED DESCRIPTION OF THE PREFERRED EMBODIMENTS

Preferred embodiments of the present invention will now be described with reference to the accompanying drawings.

Figure 1:
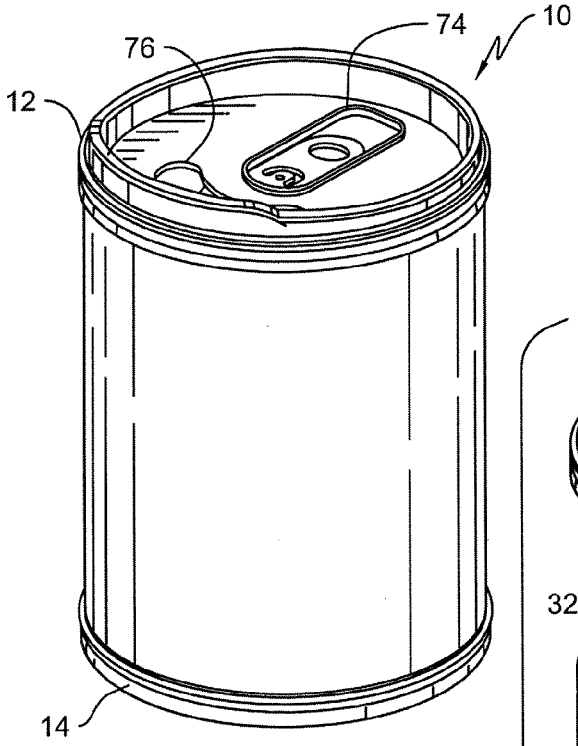
FIG. 1 is a perspective view of a container in accordance with the present invention.
Figure 2:
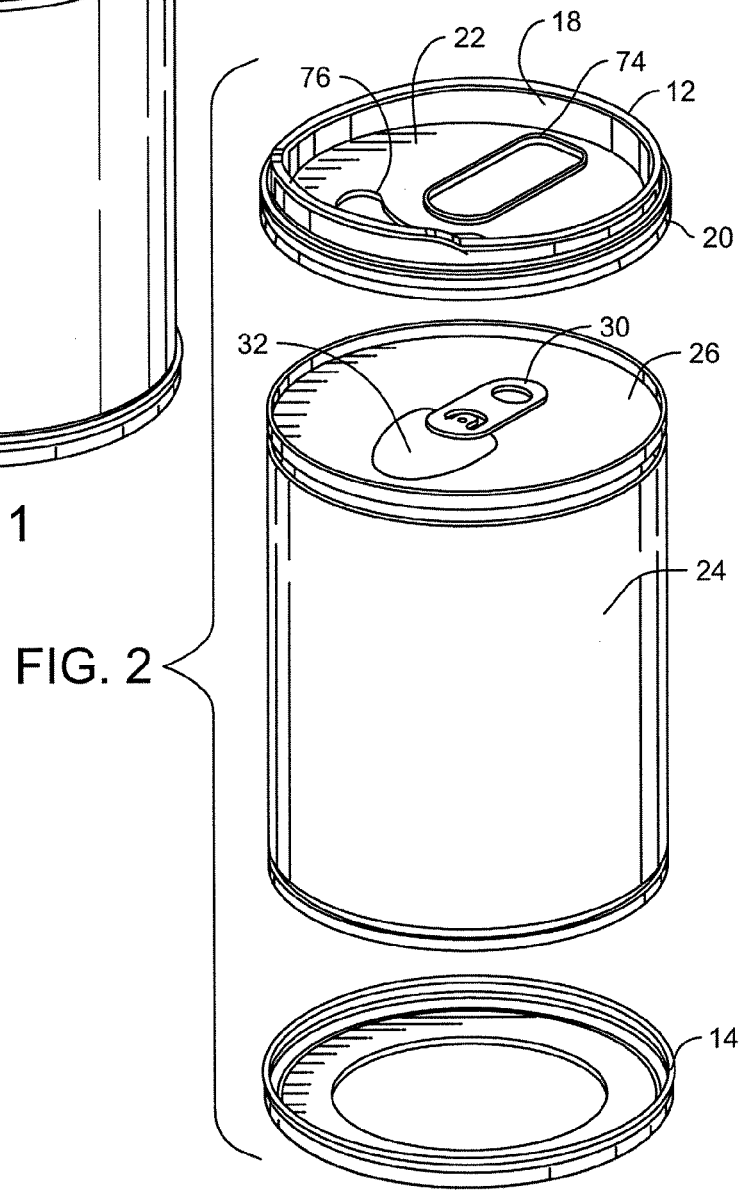
FIG. 2 is an exploded view of the container of FIG. 1 showing an induction heatable container and snap-on heat barrier ends.

Referring to the FIGS. generally and in particular to FIGS. 1-2, there is illustrated a perspective view of a container assembly 10 that can be heated by induction heating and includes top and bottom snap-on caps or covers 12 and 14, respectively. Top cap or cover 12 is generally circular in shape having an inside wall 18 and outside wall 20 having a floor 22 integrally joined to inside wall 18. Indeed, top snap-on cap or cover 12 may comprise one piece of a flexible heat barrier material.

Any suitable material, including plastic, that has heat barrier properties may be utilized in the invention. Temperatures from heating by induction may approach 140° F. or more. By heat barrier it is meant that the heat from the liquid contained in a container 24 and thereby conducted to a heat conductible material comprising container 24 is substantially blocked so the user does not burn his/her lips upon immediate contact. A user's lips contact top snap-on cap or cover 12 when the user consumes the liquid directly from container 24. The heat barrier properties or characteristics of top cap or cover 12 and bottom cap or cover 14 are distinguished from mere heat insulation properties. Heat insulation primarily keeps the contents of a container at a desired temperature, or at least reduces the temperature loss. The heat barrier material is utilized in the top and bottom ends to prevent and/or reduce the risk of potential injury to the user.

Figure 3:
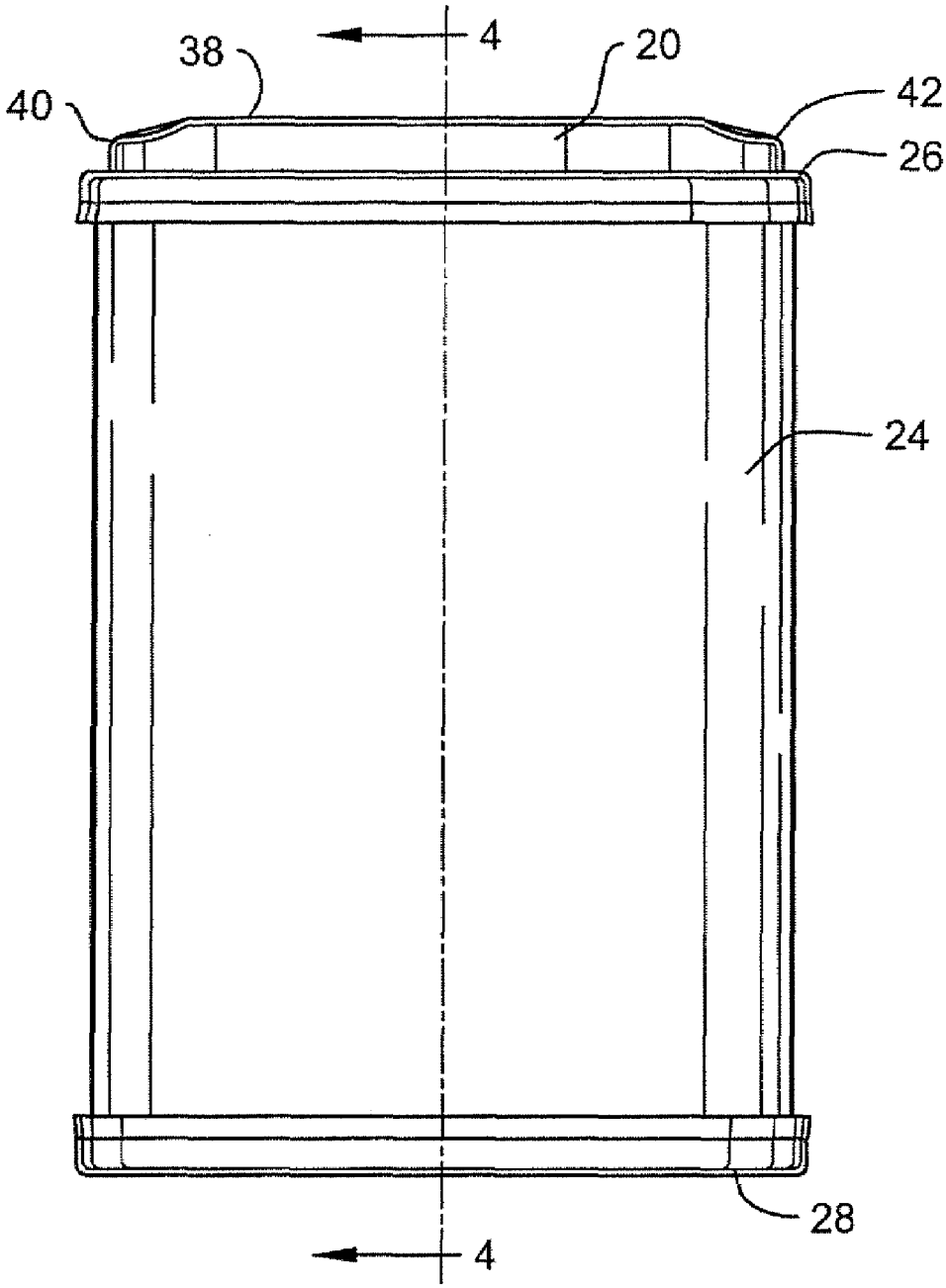
FIG. 3 is a front elevational view showing a container where the heat barrier snap-on ends include a spout on the heat barrier cover on the lid of the container.
Figure 4:
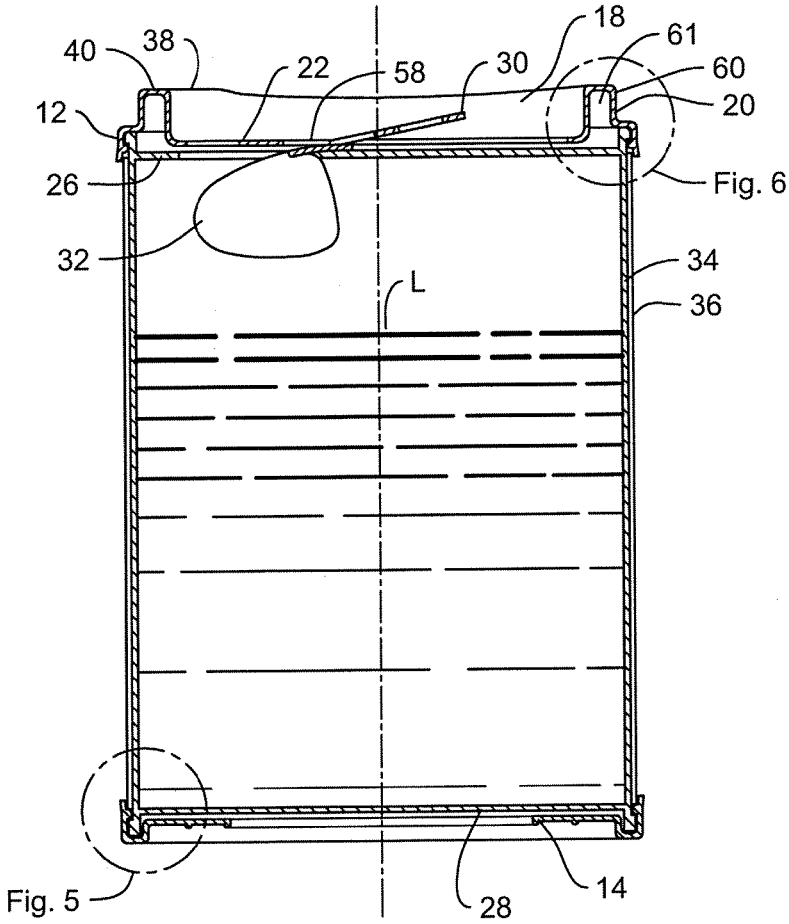
FIG. 4 is a sectional view along line 4-4 of FIG. 3.

Container 24 is preferably cylindrically shaped. A lid 26 is attached to the top of container 24 as shown in FIGS. 3 and 4 to provide an airtight hermetic seal. Container 24 is made from a heat conductible material, preferably steel so that it is suitable for magnetic induction heating. Bottom 28 is located at the base of container 24. Lid 26 has a pop-top opener 30 which pushes tab 32 through lid 26 thereby opening lid 26 allowing the hot liquid contents to flow therethrough when poured. Circular wall 34 of container 24 is generally covered with an insulating material 36 to maintain the temperature of the liquid inside the container. Typical insulating materials utilized with the container may be polypropylene, PET and thick paper. Preferably, polypropylene is utilized with the container.

FIG. 3 illustrates a front elevation view of container 24 and FIG. 4 shows a sectional view of container assembly 10 with liquid contents L contained therein. A spout 38 is shown formed from top edge 40 which is where inside wall 48 and outside wall 20 meet. Spout 38 is shown with tapering sides 42. Spout 38 facilitates drinking directly from the beverage container and also facilitates pouring of the liquid contents from the container.

Figure 5:
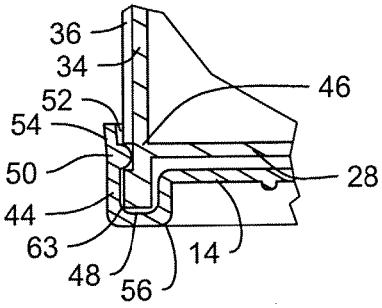
FIG. 5 is an enlarged fragmentary sectional view of FIG. 4 of the region identified by the circular dotted line where the bottom heat barrier end engages the bottom and side wall of the container.

In FIG. 5 container wall 34 is shown joining bottom cap 14 with flared portion 44 on annular can rim 46. Flared portion 44 is inside annular groove 48 formed in bottom 28. A flange 50 is formed on inside wall 52 of bottom 28 of container 24 extending radially inwardly above flared portion 44 engaging rim 46. Outside wall 54 of bottom 28 joins inside wall 52 at edge 56 which has a flat surface for supporting the container.

Figure 6:
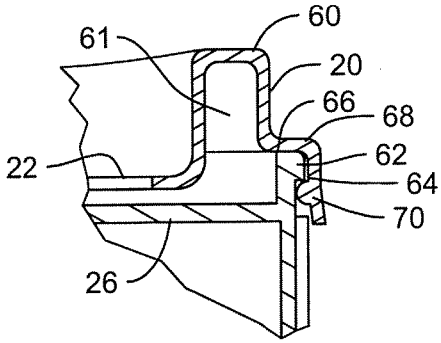
FIG. 6 is an enlarged fragmentary sectional view with circular broken lines indicated in FIG. 4 showing the top heat barrier end engaging the lid and side wall of the container.

FIG. 6 is an enlarged sectional view of lid 26 of container 24 with top snap-on cap or cover 12. Inside wall 18 is integrally formed with floor 22 of top snap-on cap or cover 12. In FIG. 4 inside wall 18 and outside wall 20 join at edge 40 forming spout 38 adjacent opening 58 in floor 22. Opposite spout 38 on annular edge 40 is ridge 60 which is raised from floor 22 to a height generally below the height of spout 38. Flare 62 of annular can rim 64 is inside annular groove 66 formed on the inside 21 of outside wall 20. Outside wall 20 forms a shoulder 68 on flare 62. A flange 70 extends radially inwardly below flare 62 to engage and grip annular can rim 64. This arrangement ensures top snap-on cap or cover 12 will provide a removable snap-on fit on rim 64 of container 24. Top snap-on cap or cover 12 can also be moved by rotating the cover so that it can be appropriately placed over the pop-top 30 and opening 58 in floor 22. An insulating airspace 61 is provided below ridge 60 and the top of lid 26 which further prevents top snap-on cap or cover 12 from becoming heated from container 24 and its contents, thereby providing a further heat barrier. As illustrated in, for example, FIGS. 1-4, insulating airspace is defined by the spacing of inside wall 18 and outside wall 20 which is bridged by annular edge 40. In this manner, an annular insulating airspace is provided between annular edge 40 and lid 26, which can provide a substantial insulating barrier. A similar arrangement could be provided for bottom snap-on cap or cover 14, if desired. As illustrated in FIG. 5, there is only a very small airspace 63. A larger airspace could be provided by extending downwardly inside wall 52 and outside wall 54. Snap-on cap or cover 12 can be readily removed from container 24 by slightly bending cap or cover 12 in a peripheral region thereof and pulling it away from lid 26 of container 24.

Figure 7:
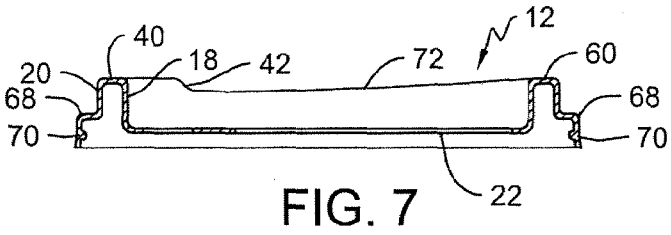
FIG. 7 is a sectional view of the top heat barrier end.

A cross section of top snap-on cap or cover 12 is shown in FIG. 7. Top edge 40 is shown being formed by the joining of inside wall 18 and outside wall 20. Shoulder 68 is deferred in outside wall 20. The center edge 72 between edges 40 and 60 is generally lower in height than edges 40 and 60, yet still supplies structural support for the top snap-on cap or cover 12 and provides an enclosure to contain liquid contents of container 24 if spilled.

Figure 8:
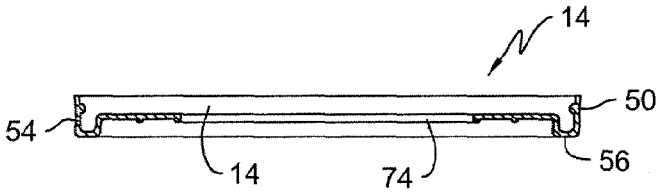
FIG. 8 is a sectional view of the bottom barrier end.

FIG. 8 shows a cross section of bottom snap-on cap or cover 14. A first aperture 74 is shown in the center of the annular heat barrier.

Figure 9:
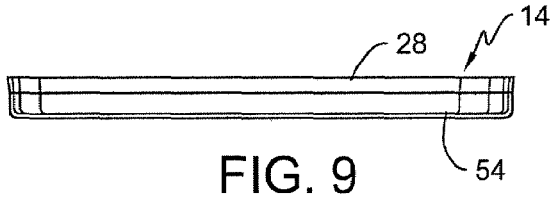
FIG. 9 is a side elevational view of the bottom barrier end.

FIG. 9 is a side view of bottom snap-on cap or cover 14 showing outside wall 54.

Figure 10:
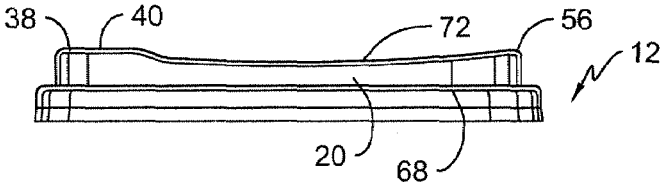
FIG. 10 is a side elevational view of the top insulating end.

FIG. 10 is a side view of top snap-on cap or cover 12 showing spout 38, edge 40, center edge 72 and opposite edge 56. Outside wall 20 is shown with shoulder 68.

Figure 11:
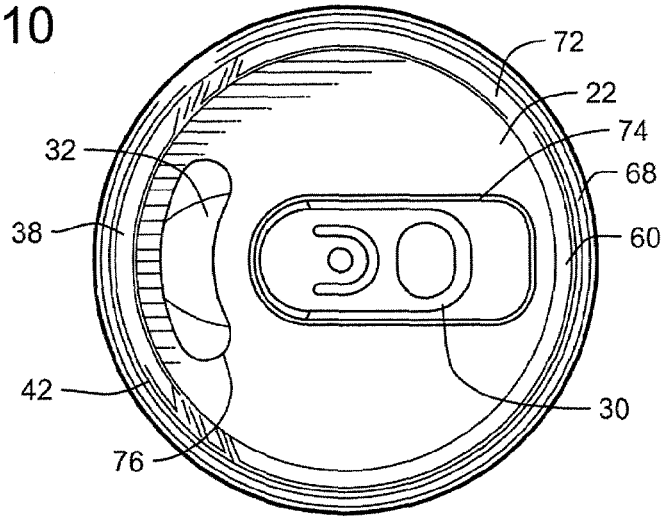
FIG. 11 is a top plan view of the container and top barrier end.

FIG. 11 is a top view of top snap-on cap or cover 12 engaged with lid 26 of container 24. Shoulder 68 is shown on outside wall 20 with ridge 60, center edge 72 and spout 38 with tapered sides 42. Floor 22 exposes pop-top 30 through first aperture 74. The pop-top can be pulled to force tab 32 to create opening 58 for pouring the liquid contents. The tab 32 is seen through a second aperture 76. Second aperture 76 is shaped in a curve that follows the curvature of inside wall 18 and is adjacent spout 38 to facilitate pouring of the liquid from the container or consumption by drinking directly from second aperture 76.

Figure 12:
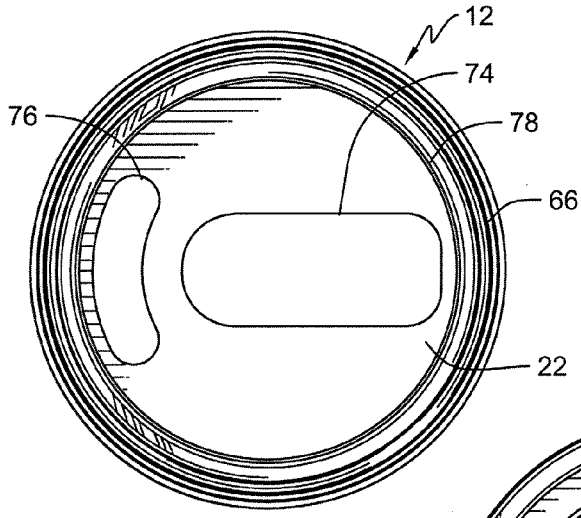
FIG. 12 is a bottom plan view of the top barrier end.

FIG. 12 is a bottom view of top snap-on cap or cover 12 showing first aperture 74 and second aperture 76. Annular groove 66 is shown as well as the inside 78 of edge 40 which follows spout 38, center edge 72 and ridge 60 around the circumference of top snap-on cap or cover 12.

Figure 13:
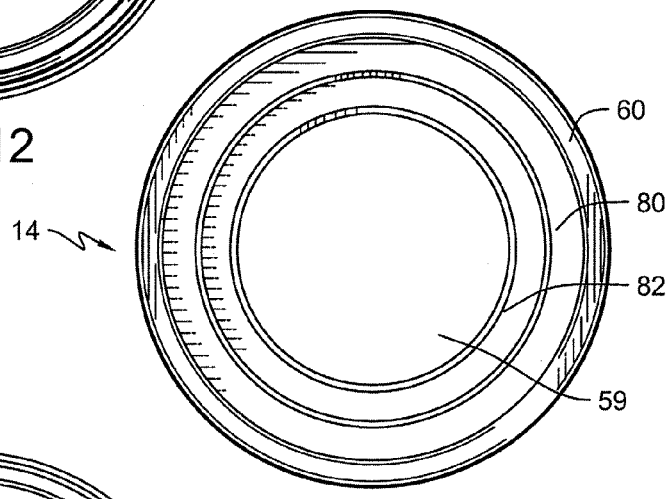
FIG. 13 is a bottom plan view of the bottom barrier end.

FIG. 13 is a bottom plan view of bottom snap-on cap or cover 14 wherein ridge 60 is shown with a flat surface used for supporting the container in an upright position. Ring 80 is utilized for structural support of the heat barrier as well as ring 82 adjacent aperture 59.

Figure 14:
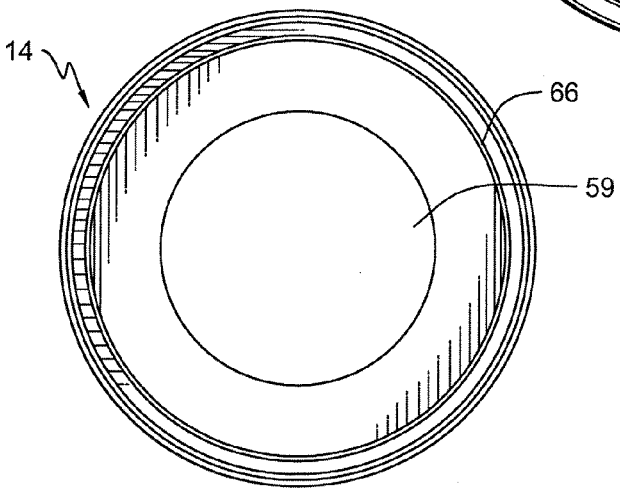
FIG. 14 is a plan view of the inside of the bottom barrier end.

FIG. 14 is an inside of top view of bottom snap-on cap or cover 14 showing annular grove 66 and aperture 59.

While the invention has been described with respect to certain preferred embodiments, as will be appreciated by those skilled in the art, it is to be understood that the invention is capable of numerous changes, modifications and rearrangements and such changes, modifications and rearrangements are intended to be covered by the following claims.

The invention claimed is:

1. A protective cover for forming a heat barrier over the lid of a metal beverage can having a top rim, and for facilitating drinking a hot beverage from the beverage can, the protective cover comprising: (a) a generally circular heat barrier cover having an annular edge bridging an inside wall with a spaced-apart outside wall; (b) a floor in the heat barrier cover; (c) a first aperture in the floor for allowing the contained beverage to be dispensed therethrough; and (d) a spout;

wherein the protective cover is attachable over the top rim on the beverage container to form an airspace that is defined by the top rim of the beverage container, the inside wall, the annular edge and the outside wall of the heat barrier cover, and wherein the heat barrier cover comprises a second aperture in the floor that is alignable with a pop-top opener of the container when the protective cover is attached over the top rim of the container, permitting operation of the pop-top opener.

2. The device of claim 1 wherein the first aperture is alignable with an opening in the lid of the beverage container when attached thereto.

3. The device of claim 1 wherein the second aperture has a generally oval shape.

4. The device of claim 3 wherein the outer periphery of the first aperture generally matches the curvature of the inside wall.

5. The device of claim 4 wherein the first aperture is arcuately shaped and the first aperture is positioned between the second aperture and the inside wall adjacent the spout.

6. The device of claim 1 wherein the circular heat barrier cover has a diameter that corresponds to the diameter of the lid of the container.

7. The device of claim 1 wherein the heat barrier cover is made from a flexible, heat barrier material.

8. The device of claim 1 wherein the protective cover is connected to the top rim on the beverage container by a circumferential flange providing snap-on attachment between the top rim and protective cover.

9. A beverage container having heat barrier covers comprising: a cylindrical container for holding liquids capable of being heated, the container having a lid and bottom connected by a side wall, an insulating material engaging the side wall; a first circular heat barrier cover conforming to the top of the container having an annular edge bridging an inside wall with a spaced-apart outside wall, a floor in the cover, an aperture in the floor for releasing the contained beverage when aligned with an opening in the top of the container, a spout integrally formed on the cover adjacent the aperture; a second circular heat barrier cover conforming to the bottom of the container having an inside wall and outside wall having a floor in the cover, and the first and second heat barrier covers attached to respective first and second rims on the beverage container, wherein an insulating airspace is defined by the top of the cylindrical container, the inside wall, the annular edge and the outside wall of the first heat barrier wherein the first heat barrier cover comprises a second aperture in the floor that is alignable with a pop-top opener of the container when the first heat barrier cover is attached over the top of the container, permitting operation of the pop-top opener.

10. The container of claim 9 wherein the second circular heat barrier cover has an aperture for releasing heat.

11. The container of claim 9 wherein the second circular heat barrier cover defining a ridge when the inside and outside walls meet for supporting the container when it is in an upright position.

12. The container of claim 9 wherein the first and second heat barrier covers are made from a flexible, heat barrier material.

13. The container of claim 9 wherein the floor in the first and second covers are integrally joined to the inside wall.

14. The container of claim 9 wherein the first and second heat barrier covers are connected to corresponding rims on the beverage container by circumferential flanges providing snap-on attachment.

* * * * *